United States Patent [19]

Schiavone

[11] Patent Number: 4,831,345

[45] Date of Patent: May 16, 1989

[54] STRIPLINE POWER DIVIDER

[75] Inventor: Frank J. Schiavone, Ridgecrest, Calif.

[73] Assignee: The United States of America as represented by the Secretary of the Navy, Washington, D.C.

[21] Appl. No.: 209,145

[22] Filed: Jun. 17, 1988

[51] Int. Cl.[4] ..... H01P 5/12

[52] U.S. Cl. ..... 333/128; 333/125; 29/846

[58] Field of Search ..... 333/128, 125, 127, 136; 29/845, 846, 830, 620

[56] References Cited

U.S. PATENT DOCUMENTS

| | | | |
|---|---|---|---|
| H27 | 2/1986 | Mosko | 333/128 |
| 2,877,427 | 3/1959 | Butler | 333/128 |
| 3,715,689 | 2/1973 | Laughlin | 333/128 |
| 3,742,392 | 6/1973 | Schwarzmann | 333/128 |
| 3,886,498 | 5/1975 | Mosko et al. | 333/128 |
| 3,955,156 | 5/1976 | Fleming | 333/128 |
| 4,450,418 | 5/1984 | Yum et al. | 333/128 |
| 4,490,695 | 12/1984 | de Ronde | 333/128 |
| 4,777,718 | 10/1988 | Henderson et al. | 333/128 X |

FOREIGN PATENT DOCUMENTS

| | | | |
|---|---|---|---|
| 0289702 | 12/1986 | Japan | 333/121 |

*Primary Examiner*—Eugene R. LaRoche
*Assistant Examiner*—Seung Ham
*Attorney, Agent, or Firm*—Stephen J. Church; Melvin J. Sliwka; William C. Townsend

[57] ABSTRACT

In a stripline power divider having a pair of conductive stripes, which are on opposite sides of a dielectric board, overlap at an input port, and then diverge oppositely to a pair of output ports individual to the stripes, the improvement characterized by the divider having an opening extending through the board and between the strips in the region where they diverge, by conductive plating extending from each stripe along the adjacent edge of the opening, and by a plug of elastomeric, lossy material fitted in the opening to electrically connect the plated edges and suppress odd mode fields between the stripes.

6 Claims, 5 Drawing Sheets

STRIPLINE POWER DIVIDER

BACKGROUND OF THE INVENTION

1. Field of the Invention

The present invention relates to the field of wave transmission lines. More particularly, the invention relates to branched stripline circuits with impedance matching.

2. Description of the Prior Art

Stripline power dividers having a broadside input port with a pair of overlapping stripes spaced by a dielectric layer and diverging in opposite directions transversely of the input stripes to a pair of output ports individual to the stripes are well known, as is the connection of the stripes in the region of their divergence by lossy material to suppress odd mode electric fields between the stripes. It is also well known to taper the stripes and configure the lossy material in this region with a variety of shapes and provide desired impedance matching for the ports while suppressing odd mode fields.

In one prior art stripline power divider of this nature, the dielectric layer between the stripes has a plurality of bores extending between the stripes where they overlap just before divergence, the bores being filled with the lossy material. This construction has particularly effective transmission and impedance matching characteristics, particularly in comparison with a similar divider having a rectangular block of lossy material inserted in the dielectric layer where the stripes overlap and where they diverge. However, this construction with bores is somewhat expensive to construct since the bores are very small and difficult to fill with lossy material. This difficulty is avoided by a power divider configuration having diverging stripes, which are on the same side of the dielectric layer and diverge from an input stripe on this side, by providing a generally triangular opening or slot through the dielectric layer where the stripes initially diverge, this opening being filled with a piece of lossy material conforming to the opening. However, it is difficult in this configuration to give the lossy material the exact size and shape of the opening, particularly where the stripes and slot have a nonlinear taper. As a result, the material either does not effectively contact the stripes, resulting in improper odd mode suppression, or overlaps the stripes, resulting in undesired even mode suppression.

SUMMARY OF THE INVENTION

The improvement, in a stripline power divider having a pair of conductive stripes on opposite sides of a dielectric layer, having an input port where the stripes overlap, and having a pair of output ports to which the stripes diverge oppositely and individually from the input port, characterized by providing an opening through the board and between the stripes in the area of their divergence, plating the two edges of the opening along the stripes with conductive material connected with the corresponding stripes, and fitting into the opening a plug of elastomeric and lossy material conforming to the opening and engaging the plated edges to electrically connect the stripes and suppress odd mode fields between them.

An object of the present invention is to provide a stripline power divider which is simple and economical to construct while providing desirable transmission and impedance matching characteristics.

Another object is to provide such a power divider having elements easily configured to shapes giving desired impedance matching.

BRIEF DESCRIPTION OF THE DRAWINGS

Other objects, advantages, and novel features of the invention will become apparent from the following detailed description thereof when considered with the accompanying drawing figures, wherein.

DESCRIPTION OF THE PREFERRED EMBODIMENT

Figure 1:
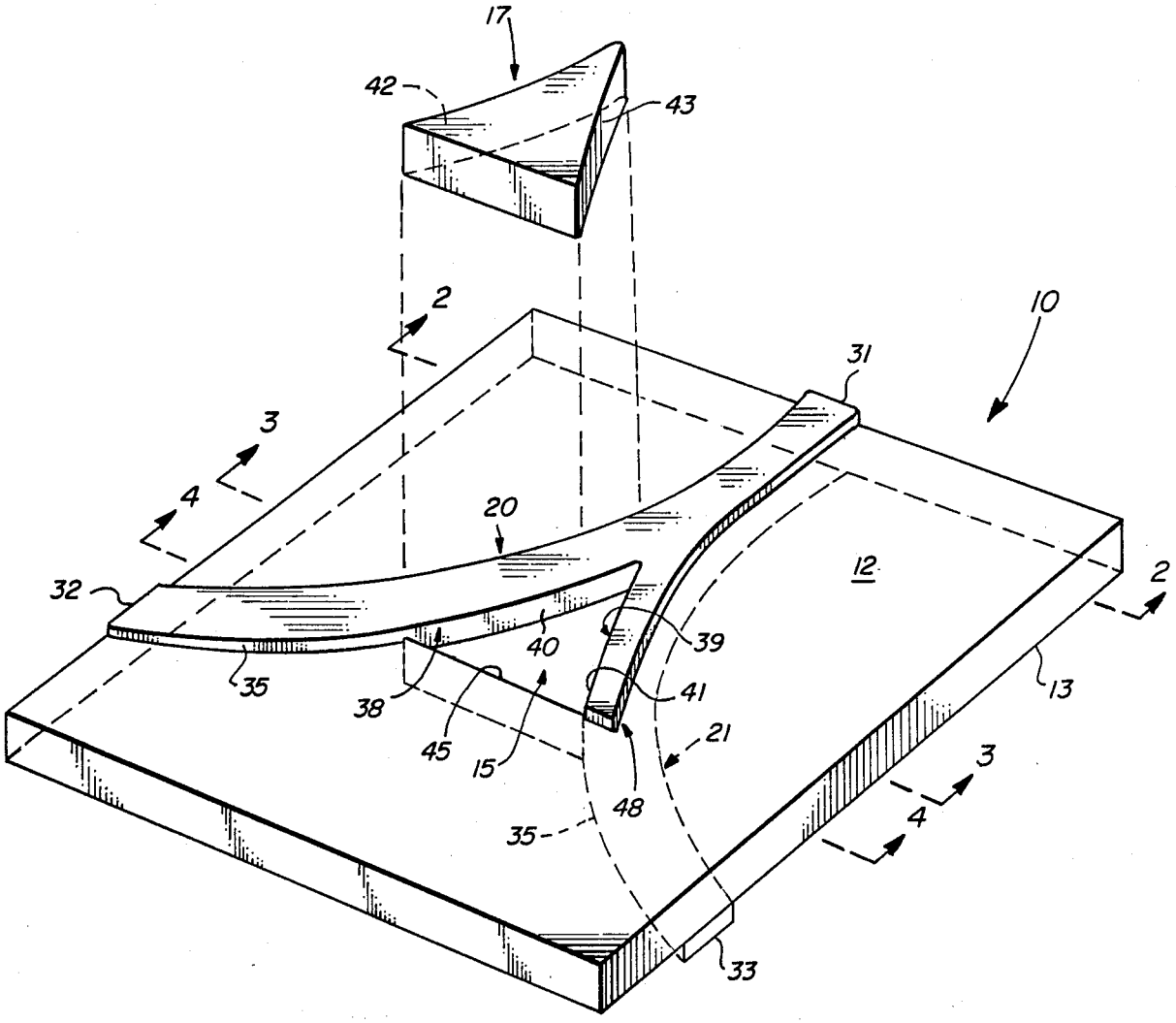
FIG. 1 is an exploded, perspective view of elements of a stripline power divider embodying the present invention.
Figure 2:
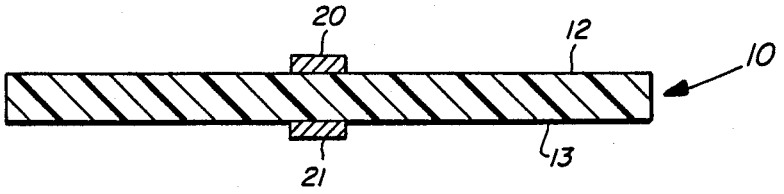
FIG. 2 is a section on line 2—2 of FIG. 1.

FIGS. 1–4 show a central dielectric layer or board 10 together with other elements of a stripline power divider embodying the present invention. Board 10 has opposite sides 12 and 13 and defines an opening 15 extending therebetween. The divider includes a plug 17 of elastomeric, lossy material such as carbon filled rubber well-known for use in microwave devices. Plug 17 conforms peripherally to opening 15 and is depicted in FIG. 1 in exploded relation to board 10, the plug being depicted in FIG. 3 in its working position received in opening 15. In such a power divider, board 10 and plug 17 are disposed, in a manner well-known and so not shown, between a pair of other dielectric boards each bearing a conductive ground plane.

Figure 3:
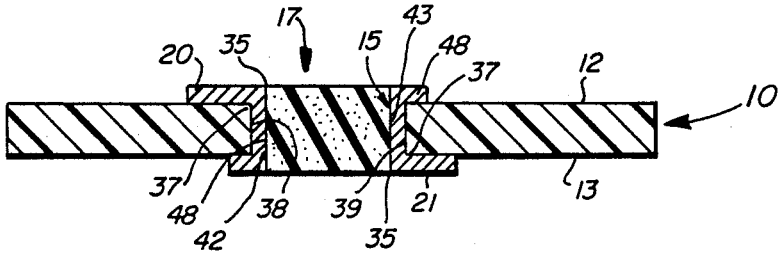
FIG. 3 is a section on line 3—3 of FIG. 1.
Figure 4:
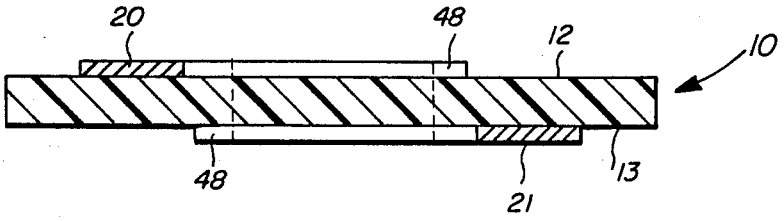
FIG. 4 is a section on line 4—4 of FIG. 1.
Figure 5:
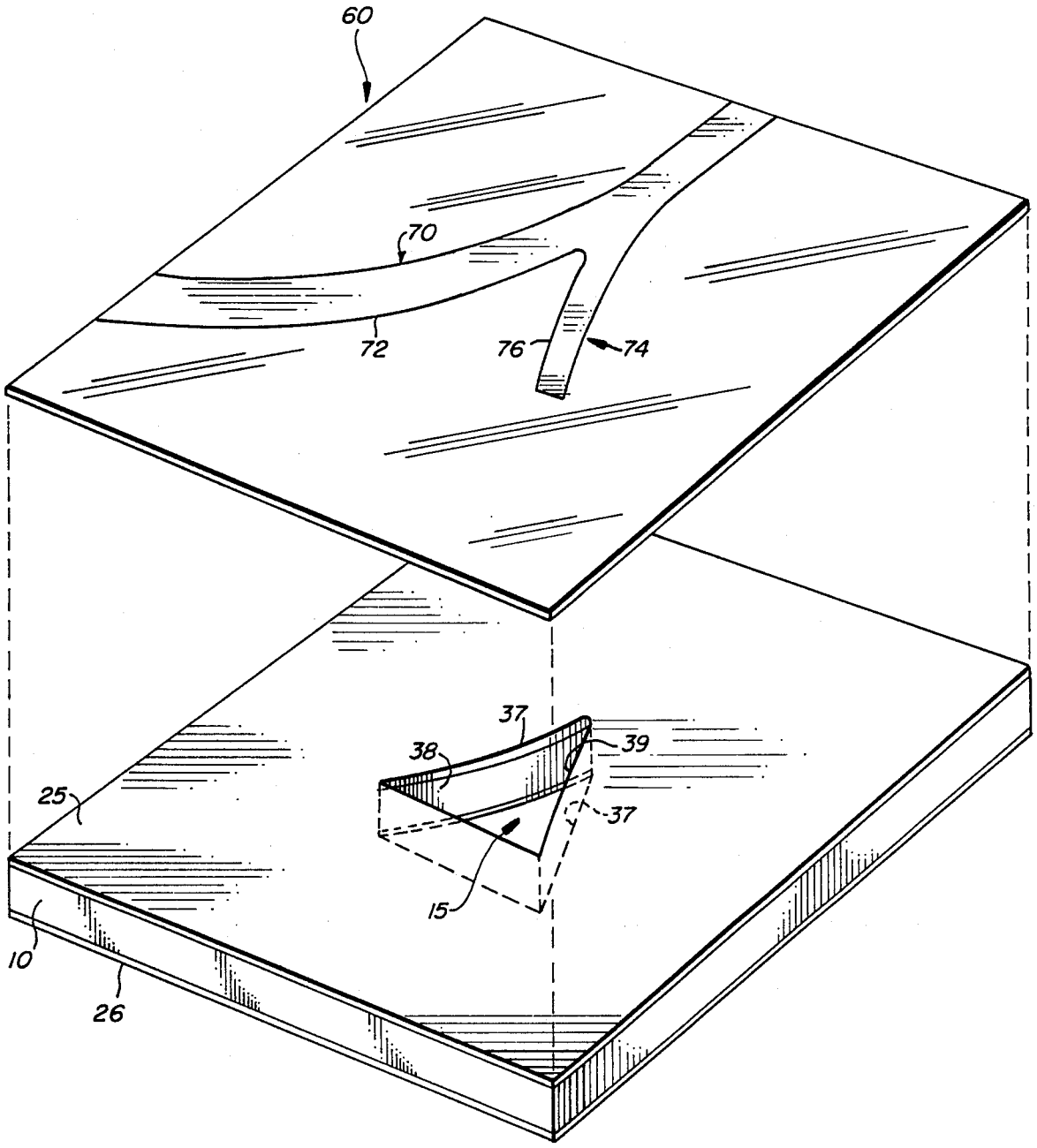
FIG. 5 is a perspective view of a dielectric layer and opposite conductive layers applied thereto after a step in the construction of the power divider of generating an opening through the layers, the layers being shown with a mask used in said construction.

The divider has a pair of conductive stripes 20 and 21 which, respectively, are borne by sides 12 and 13 and are derived from layers 25 and 26 of electrically conductive material applied oppositely to board 10 as shown in FIG. 5. Stripes 20 and 21, typically and as shown in FIG. 1, are symmetrical about a line centrally of board 10 along which the stripes overlap along a path at a first or input port 31 of the divider. Stripes 20 and 21 then diverge oppositely and transversely of this path to a pair of respective second or output ports 32 and 33. Stripes 20 and 21 diverge in a region of board 10 having opening 15. Opening 15 extends between stripes 20 and 21 in the plane of board 10 so that each stripe has an edge 35 disposed toward such edge of the other stripe and so that these edges conform individually, as shown in FIGS. 3 and 5, to intersections 37 at which a pair of opposite sides or edges 38 and 39 of opening 15 intersect with layers 25 and 26. Edges 38 and 39 thus, respectively, extend along and conform to stripes 20 and 21.

As best shown in FIGS. 1, 3, 6B, and 6C, the divider has a pair of strips 40 and 41 extending, respectively, along edges 38 and 39 of opening 15. Strips 40 and 41 are formed of electrically conducting material and are electrically connected to the corresponding stripe 20 or 21 along the intersection 37 thereof with the corresponding edge 38 or 39. Plug 17 has a pair of opposite sides 42 and 43, identified in FIGS. 1, 3, and 6C and corresponding, respectively, to opening edges 38 and 39 and thus also corresponding to strips 40 and 41. Opening 15 of the power divider shown in FIGS. 1–6C is generally triangular so that edges 38 and 39 have a junction at an apex of the opening toward port 31 and so that the opening has another side or edge 45 opposite this junction.

Figure 6A:
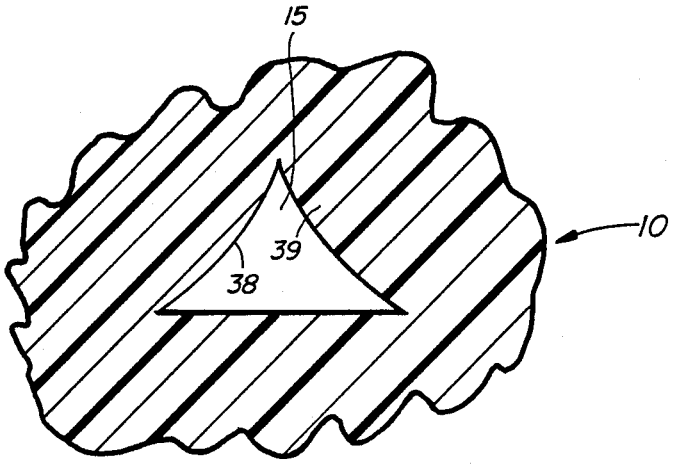
FIGS. 6A–6C are sections of the dielectric layer in the region of the opening after successive steps in said construction.
Figure 6B:
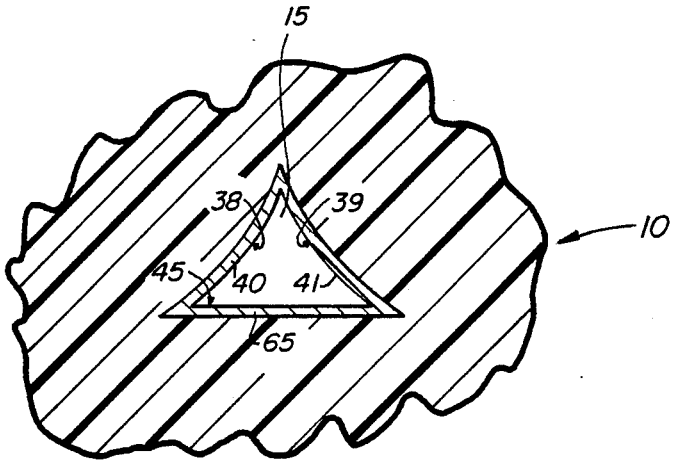

The two dimensional configuration of stripes 20 and 21 is selected in any manner, of which a number are well known to those skilled in the art of microstrip circuit design, to give proper impedance matching with circuits connected to ports 31 and 32. The configuration shown in FIGS. 1–6C has curved edges for the stripes and is selected for illustrative convenience. Another such configuration is shown in FIG. 7 and is simple to construct since the stripe edges and opening 15 are bounded by straight lines. In both of these configurations, each dielectric board side 12 or 13 bears a vestigal strip or stripe 47 disposed oppositely of and extending along opening 15 on the edge 38 or 39 thereof opposite the stripe 20 or 21 on the same board side. This vestigal stripe, which results from a subsequently described method of making the divider, has both electrical and mechanical alignment functions in the finished divider, and may connect with the same board side stripe 20 or 21 as shown in FIG. 1 or may be separated from the latter stripe by a gap 49 as shown in FIG. 7.

Figure 6C:
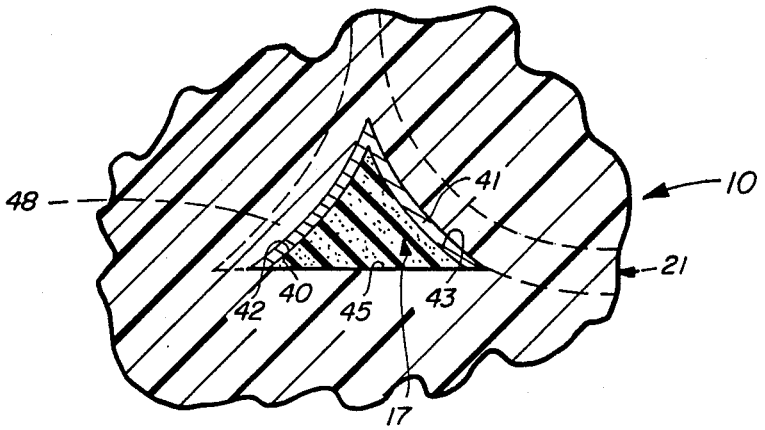
Figure 7:
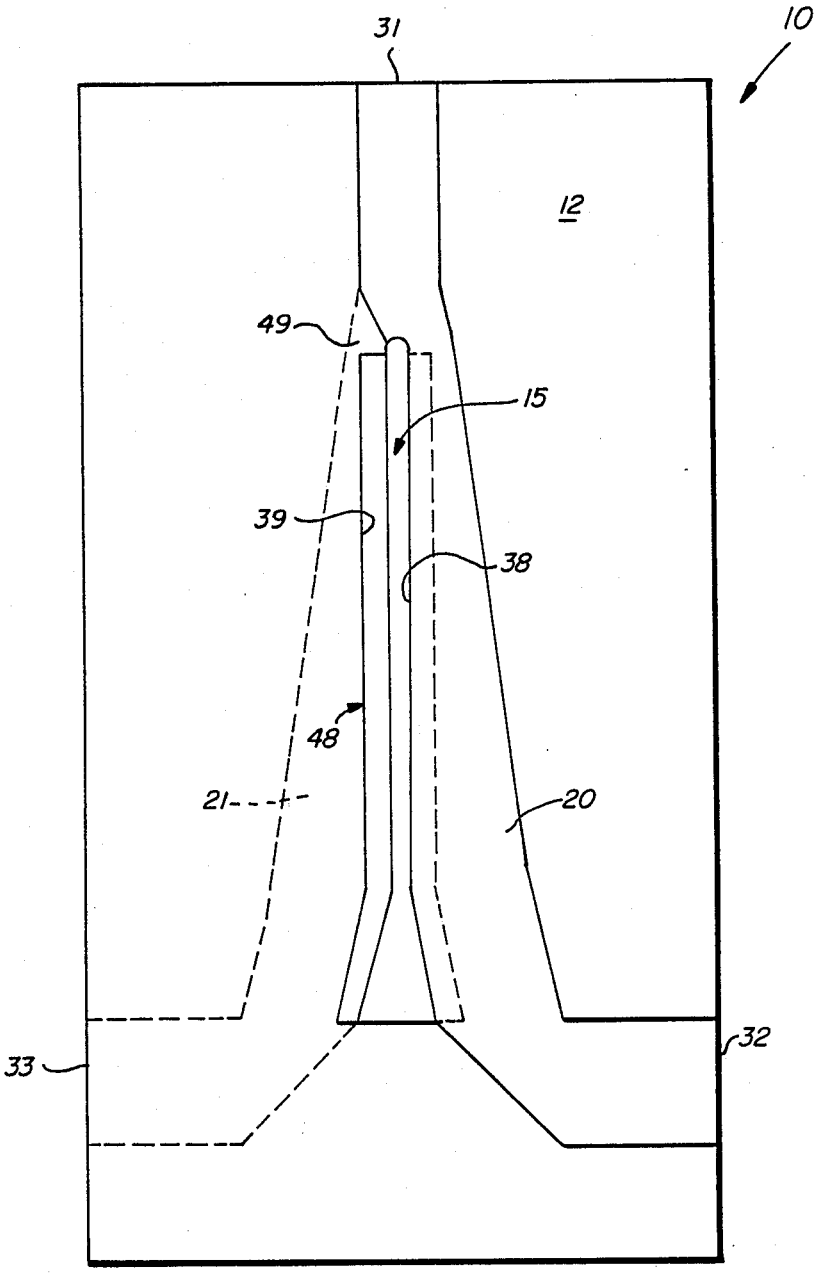
FIG. 7 is a plan view showing conductive regions of another power divider embodying the present invention.

When plug 17 is inserted in opening 15 as shown in FIGS. 3 and 6C and as suggested in FIG. 1, it is apparent that sides 42 and 43 of the plug engage, respectively, strips 40 and 41 so as to electrically connect stripes 20 and 21 with the lossy material of the plug for the suppression of odd mode electric fields between these stripes. The dimensions of plug 17 are such that the plug must be compressed to be fitted in opening 15 with the result that subsequent expansion of the plug in a direction between opening edges 38 and 39 ensures electrically connecting engagement of each of these edges with the corresponding side of the plug.

Board 10 and plug 17 may be constructed in accordance with the present invention by a method which will be apparent from FIGS. 5 and 6A through 6C. In this method, opening 15 is cut in any suitable manner through layers 10, 25, and 26 to expose dielectric layer 10 at the sides 38 and 39 of the opening as seen in FIGS. 5 and 6A. The electrically conductive material forming strips 40 and 41 is then plated on these sides so as to overlap layers 25 and 26 as shown in FIG. 3, with the result that the material of strips 40 and 41 is continuous with layers 25 and 26 and is electrically connected therewith. Stripes 20 and 21 are then formed in a manner well known in the art of printed circuit construction by coating conductive layers 25 and 26 with a resist exposed through a mask 60 shown in FIG. 5 so that subsequent etching removes from each conductive layer a portion such that the unremoved conductive layer part remains on dielectric layer 10 as one of the stripes 20 or 21, this stripe being joined along the corresponding intersection 37 with the electrically conducting material of the corresponding strip 40 or 41.

When opening 15 is plated with electrically conductive material to form strips 40 and 41 on opening sides 38 and 39, opening side 45 is, typically, plated with this material as indicated by number 65 in FIG. 6B. To prevent an odd mode short between ports 32, this material 65 is removed in any suitable manner leaving board 10 bare at opening side 45 as shown in FIG. 6C.

Plug 17 is formed in any suitable manner, as by cutting a sheet of elastomeric, lossy material to dimensions as described above, and the plug is then somewhat compressed, as before stated, and inserted in opening 15.

Referring now to FIGS. 1 and 5, it is seen that mask 60 has a first mask strip 70 corresponding to stripe 20 and that strip 70 has an edge 72 conforming to opening side 38 and to the edge 35 of stripe 20. In use, mask 60 is overlaid on layer 25 and positioned thereon by visually aligning these edges 35 and 72. It is apparent that this alignment must be precise in order that this stripe edge 35 connect with conductive strip 40 which, typically, has a thickness of 0.1 to 1.0 mil, (0.0025 to 0.025 mm). Mask 60 is, therefore, provided with a second mask strip 74 corresponding to stripe 48 and having a second mask edge 76 which conforms to opening side 39. Edge 76 is disposed in relation to edge 72 so that, after opening side 38 and 39 are plated with electrically conductive material and when one mask edge 72 or 76 is precisely aligned with the corresponding opening side 38 or 39, the other mask edge is precisely aligned with its corresponding opening edge. Mask 60 may, therefore, be positioned on layer 25 so that mask strip 70 overlays the area of this layer which is to remain thereon as stripe 20 and overlays strip 40 which is joined to stripe 20 along the edge 35 thereof. As a result, etching of layer 25 as masked by mask 60 will not destroy the electrical connection between stripe 20 and strip 40 along opening side 38. Typically, a mask similar to mask 60 is used with layer 26 to join stripe 21 with strip 41 along opening side 39.

Obviously, many modifications and variations of the present invention are possible in light of the above teachings. It is, therefore, to be understood that the invention may be practiced within the scope of the following claims other than as specifically described above.

What is claimed is:

1. In a stripline power divider having a pair of conductive stripes disposed on opposite sides of a dielectric layer with the stripes overlapping along a predetermined path at a first port of the divider and diverging, at a predetermined region of the layer, in opposite directions transversely of said path to a pair of second ports individual to the stripes, the improvement comprising:

the layer defining an opening therethrough in said region, the opening extending between the stripes and having a pair of opposite edges extending individually along the stripes;

a pair of strips of electrically conductive material extending individually along said edges, each strip being electrically connected at the corresponding one of the edges with the corresponding one of the stripes; and a plug of lossy material conforming to said opening and received therein so as to engage said strips and electrically connect the stripes for suppression of odd mode electric fields therebetween.

2. The power divider of claim 1 wherein said lossy material is elastomeric and is compressively fitted in said opening to ensure engagement of the plug with said strips.

3. A method of constructing a stripline power divider having a pair of electrically conductive stripes connected by lossy material to suppress odd mode fields and disposed oppositely of a dielectric layer with the stripes diverging at a predetermined region of the layer where each stripe has a stripe edge disposed toward the other stripe, the method comprising the steps of:

generating an opening in said region through the dielectric layer and through a pair of electrically conductive layers applied oppositely thereto, the opening having a pair of opposite sides defining with the conductive layers a pair of intersections individually conforming to and extending along each such stripe edge;

plating said dielectric layer with electrically conductive material along said opposite sides of the opening so that said material is joined to the conductive layers along said intersections;

removing a portion of each of said conductive layers so that an unremoved part of each conductive layer remains on the dielectric layer as one of said stripes joined along the corresponding one of said intersections to said electrically conductive material;

forming a plug from such lossy material, the plug conforming to said opening and having a pair of opposite sides individually corresponding to said opposite sides of said opening; and inserting the plug into said opening with said opposite sides of the plug in electrically connecting engagement with said conductive material plated on the corresponding sides of the opening.

4. The method of claim 3 wherein said lossy material is elastomeric and wherein said method further comprises forming the plug with dimensions such that the plug is compressed when inserted in said opening and subsequent expansion of the plug in a direction between said opposite sides of the opening ensures said electrically connecting engagement.

5. The method of claim 3 wherein said opening has another side which is plated with said electrically conductive material when said opposite sides are plated therewith, and wherein the method further comprises removing said material from said another side prior to inserting said plug in said opening.

6. The method of claim 3:

wherein the step of removing such a portion of one of said conductive layers with such an unremoved part thereof remaining as said one stripe involves a mask having a first mask strip which corresponds to said one stripe and which has a first mask edge conforming to such stripe edge of said one stripe and to the corresponding one of said opposite sides of said opening, the mask being positioned on said one layer by aligning said first mask edge with said one opening side said after plating step; and wherein the mask has a second mask strip having a second mask edge which conforms to the other of said opposite sides of the opening and which is disposed in relation to said first mask strip so that, when said first mask edge is precisely aligned with said one opening side after said plating step, said second mask edge is precisely aligned with said other opening side, so that, when said one conductive layer is overlaid by the mask with said mask edges aligned with their corresponding opening sides, the mask is disposed with said first mask strip overlaying an area of said one layer corresponding to said unremoved part thereof and overlaying such electrically conductive material plated on the opening side corresponding to said part and joined thereto.

* * * * *